US005720664A

United States Patent [19]

Brubacher

[11] Patent Number: 5,720,664

[45] Date of Patent: Feb. 24, 1998

[54] INDOOR TARGET SHOOTING PRACTICE SYSTEM

[76] Inventor: Michael Brubacher, 6222 E. Janice Wy, Scottsdale, Ariz. 85254

[21] Appl. No.: 617,095

[22] Filed: Mar. 18, 1996

[51] Int. Cl.[6] ..... F41J 9/20; F41J 9/30

[52] U.S. Cl. ..... 463/52; 124/8; 273/362

[58] Field of Search ..... 463/52, 49, 50, 463/51; 273/362, 363, 364, 365; 124/7, 8, 9

[56] References Cited

U.S. PATENT DOCUMENTS 2,568,279 9/1951 Franz et al. ..... 273/362 X 3,748,751 7/1973 Breglia et al. ..... 463/51 X 4,640,514 2/1987 Myllyla et al. ..... 463/51

5,050,575 9/1991 Killion ..... 124/8

*Primary Examiner*—William H. Grieb

*Attorney, Agent, or Firm*—Gregory J. Nelson

[57] ABSTRACT

A practice targeting and shooting system having a laser emitter and a light detector which is attachable to a shotgun. Reusable, reflective disc-like targets are launched by a thrower. The shooter arms the shotgun and actuates the emitter. If a predetermined portion of the light beam strikes the target, it is reflected and sensed by the detector which registers a "hit" by a suitable audible and/or visual signal.

11 Claims, 4 Drawing Sheets

INDOOR TARGET SHOOTING PRACTICE SYSTEM

BACKGROUND OF THE INVENTION

Field of the Invention

The present invention relates to a practice targeting and shooting system and more particularly relates to a practice targeting and shooting system which uses a laser emitter and detector unit in conjunction with flying targets which targets have a special retro-reflective coating. The emitter selectively emits light which is reflected by a target when hit and is sensed by the detector which emits a signal indicating a hit.

Trap and skeet shooting is a popular sport both with hunters and shooters. Hunters participate in trap and skeet shooting as a means of practicing bird hunting skills and many shooters engage in trap and skeet shooting both as a recreational and competitive sport. In trap and skeet shooting, targets or "clay pigeons" as they are sometimes termed, are selectively ejected from a trap in various directions and at various elevations. The shooter attempts to hit the airborne targets. Skeet shooting is a variant of trap shooting in which the shooter attempts to hit the targets from various selected locations.

While trap and skeet shooting are enjoyable sports which serve to enhance the shooters skills, trap and skeet shooting activities have a number of disadvantages. These activities must be pursued out-of-doors so that during periods of inclement weather, shooters may not be able to participate in these activities. Also, there is a safety element as use of shotguns with live ammunition requires shooting be practiced in an open field area. Further, conventional skeet and trap shooting is expensive as both the ammunition and the targets are not reusable and may involve considerable expense.

SUMMARY OF THE INVENTION

Therefore, based on the foregoing, there exists a need for a practice targeting and shooting system which allows the shooter to practice indoors and which does not involve the discharge of live ammunition. With the system of the present invention, reusable retro-reflective targets are utilized in place of actual clay targets. The system simulates actual trap and skeet shooting conditions. The present invention maximizes the benefits of practice as it allows the user to practice with the user's firearm. The system has an emitter which emits a pulse of visible laser light in a simulated shotgun pattern and provides an audible or visible indication of a hit when at least a part of the light pulse is reflected and sensed by the light detector section of the system.

Briefly, the present invention has two principal components: (1) the target thrower, and (2) the laser emitter light and detector unit. The target thrower comprises a table which is supported on legs which are adjustable to vary the flight path of the targets. The thrower has a spring loaded rotating throwing arm which, during its rotational path, is placed in tension so that it quickly releases to impact and eject a target. The targets consist of light-weight disc-like reproductions of clay targets having an retro reflective surface. The targets may be loaded in the target thrower singly or fed by an auto feed magazine.

The laser emitter and detection component of the system attaches to the barrel of the user's shotgun to duplicate outdoor shooting conditions. Alternatively, the laser emitter and detector can be an integral part of a practice or simulated shotgun device. The laser emitter portion of the emitter and detector unit emits a light pulse in a simulated shotgun pattern. Each time the emitter is manually actuated, a brief pulse of light is emitted which, if at least a significant part of the light beam strikes the target, is reflected from the retroreflective surface of the target and sensed by the detector causing an audible or visible tone to be generated. The laser emitter can be indexed for both lead and impact point by appropriate setting of adjustment controls. With these features the shooter can duplicate the correct shot trajectory and lead for a target travelling at conventional speeds and at any angle within the confines of an indoor practice area.

BRIEF DESCRIPTION OF THE DRAWINGS

The above and other objects and advantages of the present invention will be more fully understood from the following description, claims and drawings in which:

Figure 1:
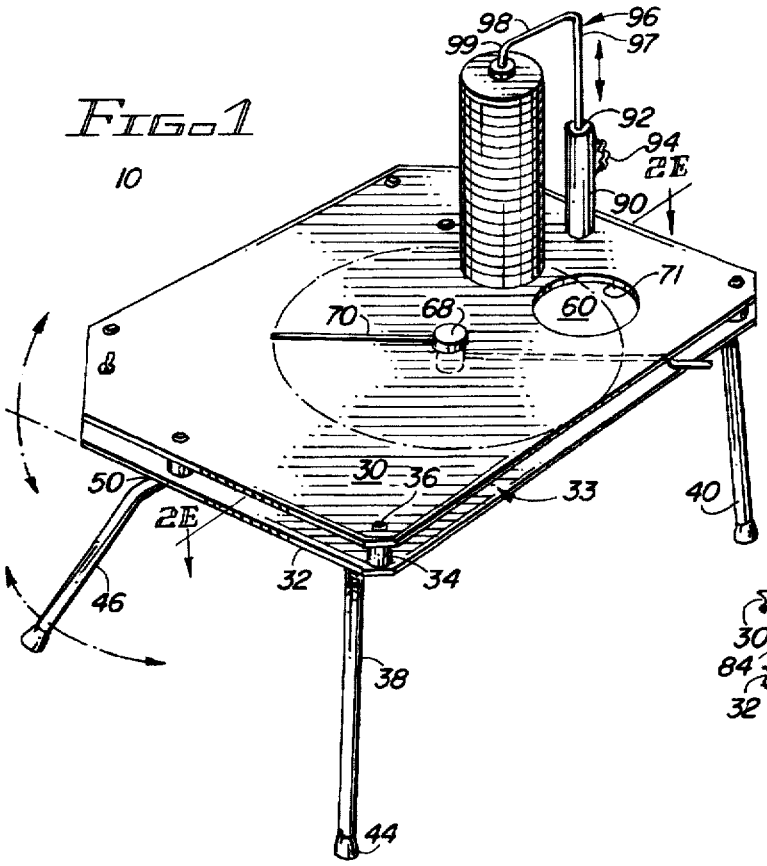
FIG. 1 is a perspective view showing the thrower component of the target and shooting system of the present invention.
Figure 4A:
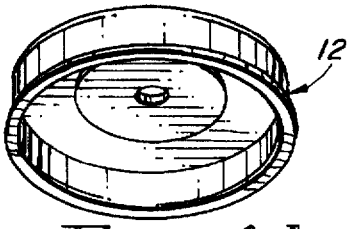
FIG. 4A is a bottom perspective view of a target.
Figure 4B:
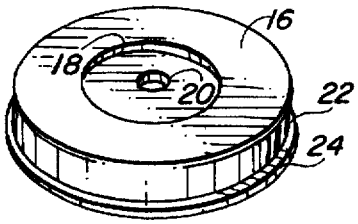
FIG. 4B is a top perspective view of a target.
Figure 10:
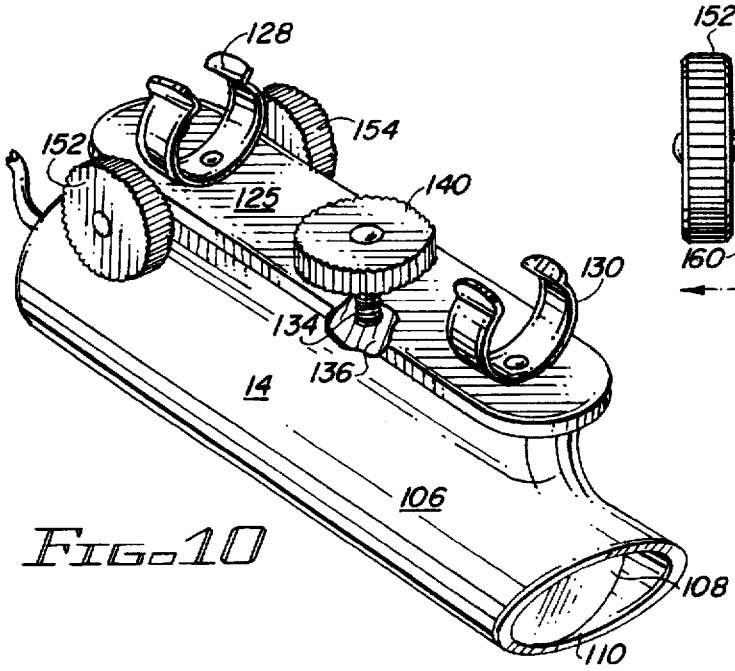
FIG. 10 is a perspective view of the emitter and detector component of the target and shooting system.
Figure 13:
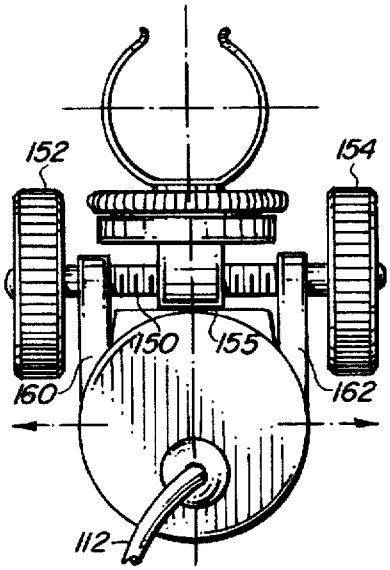
FIG. 13 is a rear view of the emitter and detector component.
Figure 12:
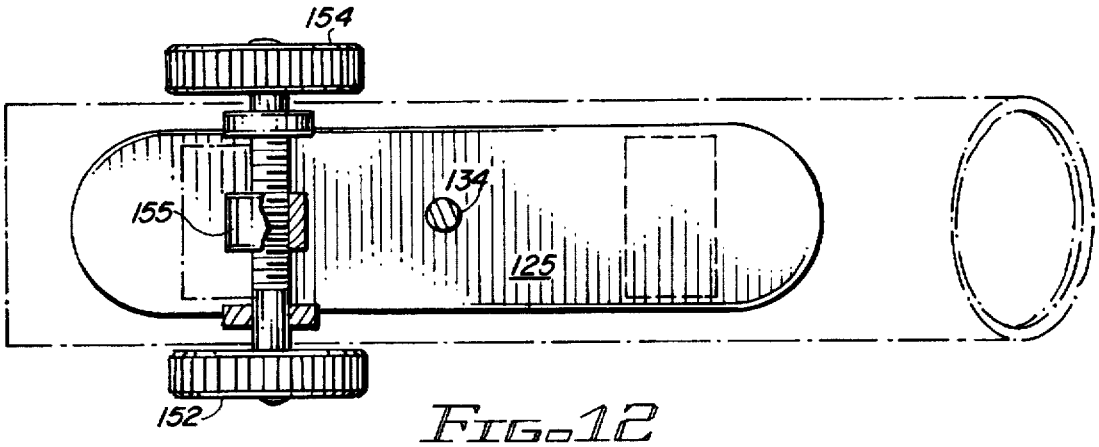
FIG. 12 is a view taken along Line 12—12 of FIG. 10.

Turning now to the drawings, the laser targeting and shooting system of the present invention utilizes a thrower identified by the numeral 10 and, as shown in FIG. 1, ejects a target 12 of the type best seen in FIGS. 4A and 4B. A laser emitter and detector unit 14, as shown in FIG. 10, emits a pulse of light in a simulated shotgun pattern and detects reflected light to sense the presence of a "hit".

The target 12, FIGS. 4A and 4B, are lightweight discs which are scaled-down reproductions of conventional clay targets which targets are discharged or ejected at selected distances, as for example, 20 to 55 feet and at scale speeds up to 60 mph. The discs are fabricated from a suitable material such as lightweight plastic such as PVC or vinyl. Preferably the individual discs weigh approximately 0.2 oz. Each target has circular upper surface 16 which defines a concentric recess 18 having a bore 20 centrally located in the surface. A peripheral wall 22 extends about the upper surface and terminates at a lower outwardly extending flange 24. The wall 22 is provided with an exterior coating of a retro-reflective surface which may be in the form of a band of adhesively backed reflective tape which extends circumferentially around the wall. The targets are adapted to be stackable and are ejected by the thrower 10 as best seen in FIGS. 1 through 8.

Figure 8:
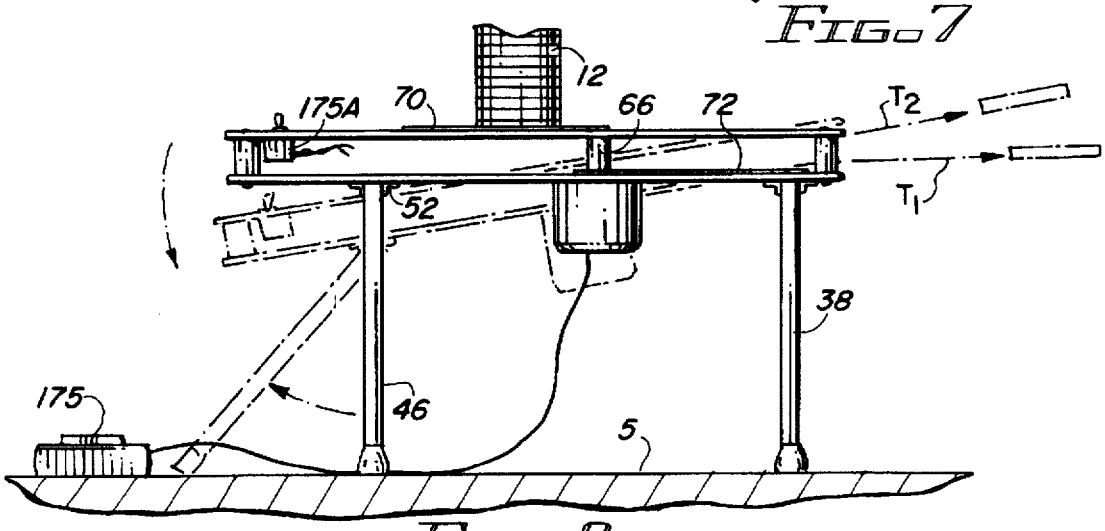
FIG. 8 is a side view of a thrower with an alternate target trajectory position being shown in phantom lines.

The thrower 10 has a table which consists of a top panel 30 and a lower panel 32 which are held in spaced-apart relationship by spacers 34 positioned at selected locations around the panels. Suitable fasteners 36 secure the panels together. The panels are both planar and similarly dimensioned. A target discharge slot 33 is defined between the front edge of the panels. The table is mounted on fixed front legs 38 and 40 which are both rod-like members depending from panel 32. The legs may be provided with suitable tips 44 to provide better frictional engagement with the supporting surface. A pair of rear legs 46 are interconnected by a bight section 50. The rear legs 46 depend from the lower panel 32. The bight section 50 is secured to the underside of the table by one or more U-shaped clamps 52 to permit the rear legs 46 to be rotated. As best seen in FIG. 8, the angular orientation of the table with respect to the supporting surface S can be varied by pivoting the legs 46 from a generally vertical to an angular position as shown in phantom lines. The rotational positioning of the legs in this manner has the effect of changing the trajectory of the flight path of the target ejected from the thrower at discharge slot 33. T1 indicates a generally horizontal trajectory while T2 indicates a higher elevation trajectory which was achieved by rotating the rear legs 46 rearwardly as shown in phantom lines which has the effect of upwardly inclining the table.

The targets are loaded into and ejected from the pad 60 which is located on the upper surface of the lower panel 32. The pad area 60 is shown as having a surface of increased frictional characteristics which may be achieved by applying a grit material such as sand paper to the surface.

Figure 5:
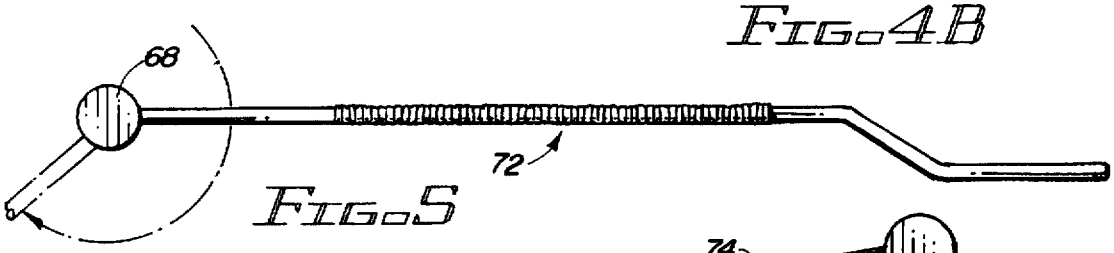
FIG. 5 through 7 are detailed views of a target throwing arm in sequential operational positions.
Figure 6:
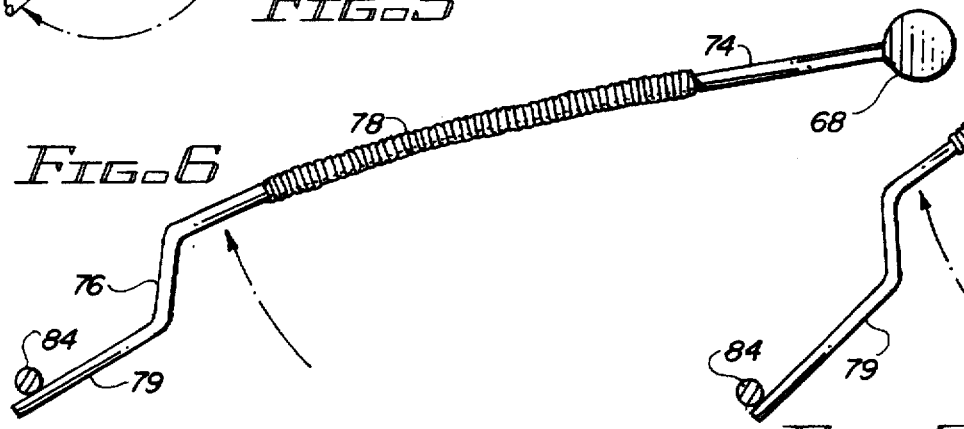
Figure 7:
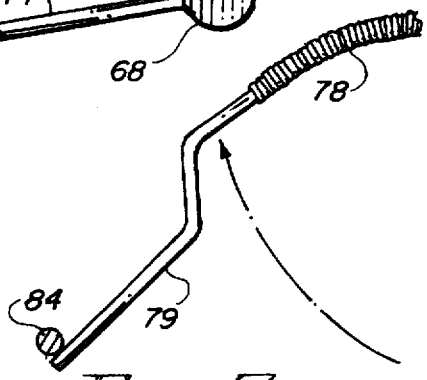

A small electric gear motor 65 having a relatively low output speed as, for example, 8 to 10 rpm at output shaft 66 is secured to the underside of panel 32. The output shaft 66 extends vertically upwardly through the panels 30, 32 terminating at a cap 68 at the upper side of upper panel 30. A radially extending sweep arm 70 is secured to the cap 68 shown as a metal rod, positioned having a slight clearance above the upper surface of panel 30. A throwing arm 72, which is shown in greater detail in FIGS. 5 through 7, is secured to the output shaft 66 intermediate the panels 30 and 32. The throwing arm has an inner radial extending section 74 which is substantially rigid and a tip 76 which is also substantially rigid. The sections 74 and 76 are interconnected by a tightly wound compression spring section 78. Tip 76 is shown as being somewhat S-shaped having an off-set distal end section 79.

Figure 2A:
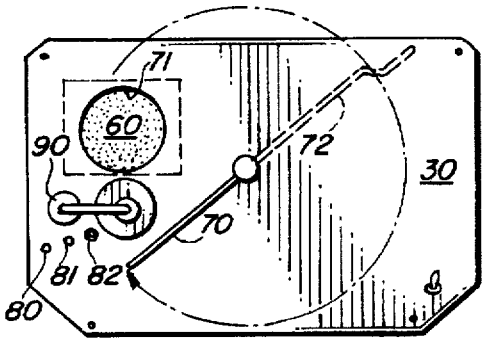
FIGS. 2A through 2D are plan views of the thrower illustrating the sequence of the steps that occur in loading and discharging a target.

The off-set end section 79 engages the target and discharges it from between the panels at slot 33. The arm operates in a manner similar to a sling or catapult. A tensioning pin 84 is inserted in one of the holes 81, 82, 83 in the table panels 30. The amount of energy stored within the spring 78 and, accordingly the distance which the target is thrown, is determined by the tension setting which is established by placement of the pin 84 in one of three holes. Placement of the tensioning pin in innermost hole 82, as seen in FIG. 2A, results in the target 12 being thrown the greatest distance. The location and number of holes may be varied to some extent based on the requirements of the user.

It will be appreciated that as the arm rotates, the distal end 79 will contact the pin 84. The motor 65 continues to rotate the arm 72 and the end of the arm is retained by the pin causing energy to be stored in the spring 78. At a point in time, the distal end 79 of the arm will, due to the energy stored in the spring, quickly release from the pin 84 and will spring forward impacting the target 12 positioned in the pad area 60. The impact will cause the target to be ejected through slot 33 a distance in accordance with the tension setting of the spring and at a trajectory determined by the angular inclination of the table.

Figure 3:
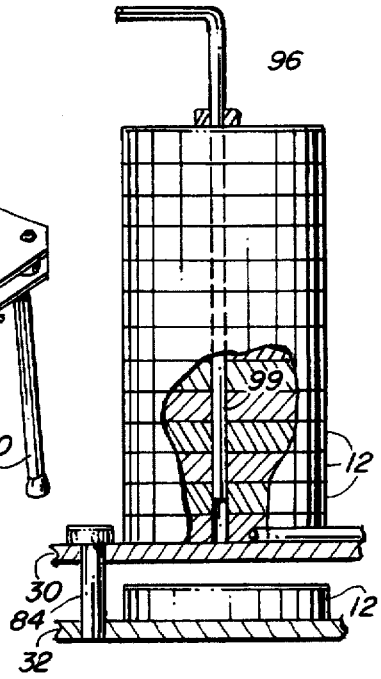
FIG. 3 is a detailed view of the automatic target loading magazine.

The present invention allows the user to load targets singly by hand and also has provision for loading a magazine containing a plurality of targets so that targets will be continuously ejected from the thrower 10 until the magazine supply is exhausted. The magazine is best seen in FIGS. 1 and 3 and consists of a tube 90 which extends vertically from panel 30. Tube 90 has an axially extending bore 92 which is intercepted by a transverse threaded bore in which adjustment screw 94 is received. The magazine further includes a stacking rod 96 which is generally U-shaped having a vertical section 97 which is received within the bore 92 and which may be adjustably positioned with respect to the tube and secured in desired position by means of adjusting screw 94. The stacking rod includes a horizontal section 98 and a downwardly depending vertical section 99 which, when a plurality of targets are loaded, extends through the bores 20 within the targets. The stacking rod is positioned so the end of rod section 99 is located above panel 30 a distance slightly greater than the thickness of a single target. This is illustrated in FIG. 3 and this positioning provides clearance for loading arm 70 allowing it to pass beneath the end of rod section 99.

It will be appreciated that as the drive motor 65 rotates the loading arm, the loading arm will rotate into engagement with the lower most target in the stack of targets in the magazine rod. The loading arm 70 will advance the lower most target bringing it into registry aperture 71 in the upper panel 30. The target will then drop through the panel onto the pad area 60 in a position to be ejected by the throwing arm 72 which follows or trails the loading arm by approximately 180 degrees.

Figure 2B:
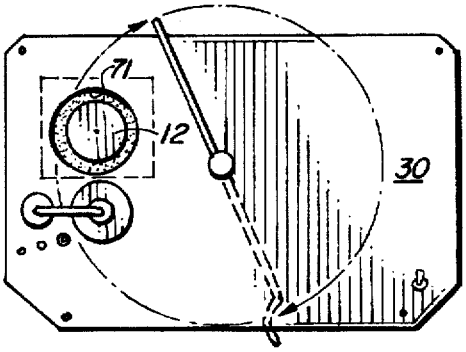
Figure 2C:
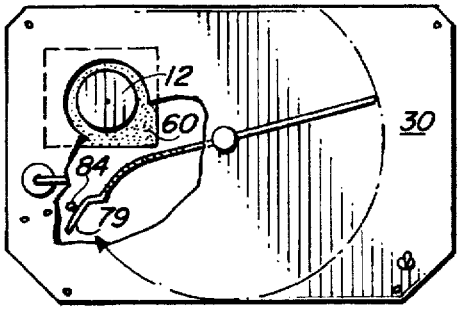
Figure 2D:
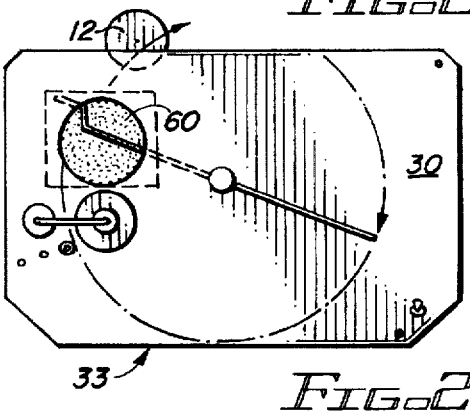
Figure 2E:
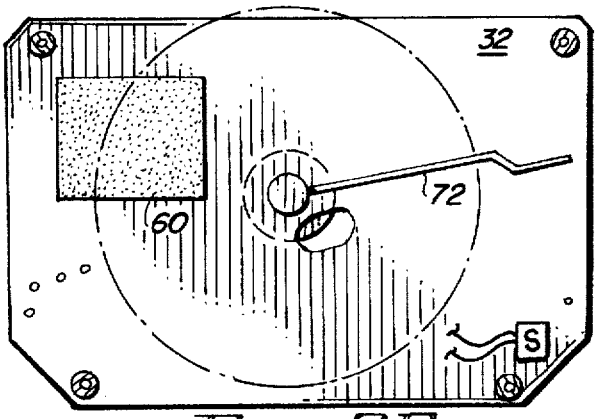
FIG. 2E is a sectional view taken along Line 2E of FIG. 1.

The sequence of operation is best shown in FIGS. 2A through 2E. In FIG. 2A the loading arm 70 is shown approaching the magazine. In FIG. 2B, the loading arm has passed the aperture 71 causing the lower most target in the magazine to be advanced into position on launching pad 60. In FIG. 2C, the throwing arm is shown in a position in engagement with pin 84 in hole 82. The arm has moved forward to a position storing energy in the spring 78. FIG. 2D the throwing arm has released from the pin 80 springing forwardly impacting the target causing the target to be ejected from the thrower at slot 33. FIG. 2E is a plan view of the lower panel 32 showing the panel after a target has been ejected and as the throwing arm is rotated towards the launching area 60 at a point in the operational cycle just prior to the time when the next target has been advanced to the area 60.

Figure 11:
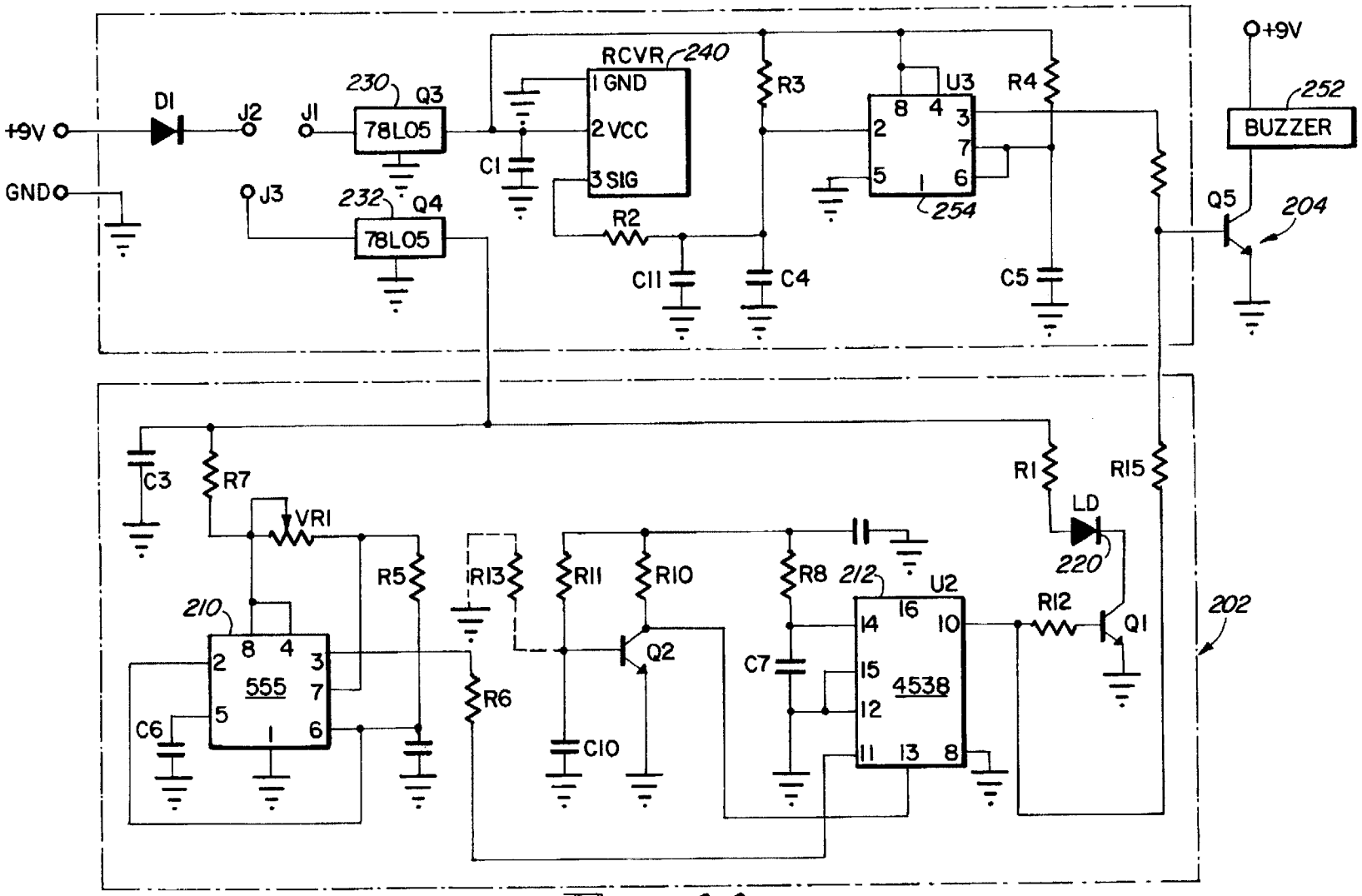
FIG. 11 is a schematic view of the emitter detector circuitry.

As indicated above, the targets are used in conjunction with a laser emitter and detector. The laser emitter and detector unit is best shown in FIGS. 9 through 13. In FIG. 10 the emitter and detector unit 14 is shown in conjunction with a conventional firearm such as a shotgun 100 which has a barrel 102. It will be appreciated that the emitter and detector unit may be provided as an accessory attachable to conventional firearms or may be made a component of a special practice firearm. However, for purposes of description, the emitter and detector unit will be described as an accessory which may be secured to an existing firearm of the user allowing the user to practice with the users shotgun to enhance the value of the practice session. The emitter and detector unit has a body 106 which is in the form of an elongate tube having an open end 108 in which a lens 110 is received. The lens focuses a light pulse emitted in a simulated shotgun pattern scaled for reduced target distance. The body contains the electronic circuitry which will be described in detailed hereafter and is shown in FIG. 11. The emitter is actuated by trigger 110 connected to the electronic circuit by means of cable 112. The trigger 110 may be secured to or adjacent the trigger of the firearm by attachment means 112 which may be an adhesive or a strip of loop and hook fabric type fastener material Alternatively, the body may be sized and shaped as a shotgun shell so that it may be positioned in the empty chamber of the shotgun so that the firing pin of the shotgun will contact the actuating button 114 when the firearm trigger is pulled causing the emitter to emit light in a simulated shotgun pattern for a predetermined time as for example a 50 millisecond pulse.

Figure 9:
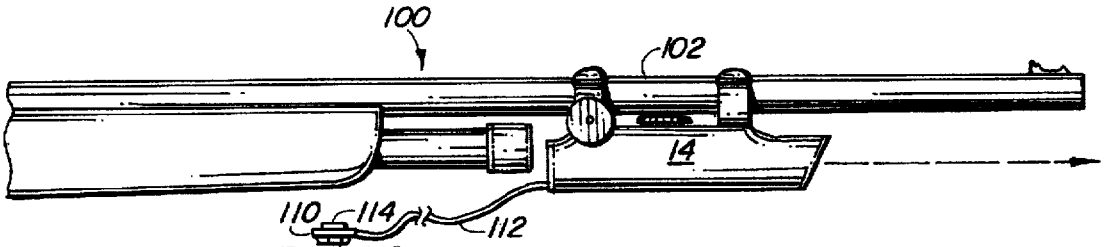
FIG. 9 is a elevational view showing the barrel of a conventional shotgun with the emitter and detector attached thereto.

The emitter and detector unit includes an elongate mounting plate 125 which carries a pair of spring clips 128 and 130 which may be engaged about the barrel 112 of a shotgun as shown in FIG. 9. At a location intermediate the clips, a screw 134 is received in a threaded bore 136 in the upper portion of the housing or body of the emitter and detector unit. The screw is provided with an elevational adjustment knob 140 which is disposed on the upper side of the mounting plate 125. It will be apparent that by rotating the adjustment knob 140, the body of the emitter and detector unit will be raised or lowered that is, the axial center line of the emitter and detector unit may be raised or lowered with respect to the bore of the shotgun.

In addition to the elevation adjustment, lead adjustment is provided by means of transversely extending screw 150 which has adjustment knobs 152 and 154 at its opposite ends. The lead screw adjustment extends through a internally threaded traveler 155 which extends and is secured to the underside of the mounting plate 125. Flanges 160 and 162 at opposite of the body 106 support the screw for rotation. It will be apparent that by rotating the screw in one direction or the other by means of adjustment knobs 152 and 154 body 106 of the emitter and detector unit will be caused to rotate about the vertical axis of screw 134 positioning the axis of the body 166 at a lead or lag angle with respect to the axial bore of the shotgun barrel 102.

FIG. 11 is a schematic of the circuitry of the light emitter and detection circuitry within the emitter and detector unit 14.

Numeral 202 represents the emitter and numeral 204 represents the receiver. Emitter 202 includes a 40 KHz transformer generator 210 connected in a circuit to pulse timer 212. Laser diode or LED 220, emits a pulse of light once actuated, the duration of which is controlled by the pulse timer 212. A 50 millisecond burst is typical.

The receiver 204 is powered by connecting the actuator or firing button to the unit. Voltage regulators 230 and 232 regulate the supply voltage to the receiver and emitter. When the target is struck by at least a portion of the light beam, the modulated light is reflected from the target. The receiver circuit includes 40 KHz receiver/filter/amplifier 240 which generates a voltage. Reflected light impinging on receiver 240 will then energize buzzer 252 for a period of time established by timer 254.

Various light detection and emitter circuits are well known to those skilled in the art and accordingly further detailed description of circuits of this type is not believed necessary. It is to be understood that various of these circuits will work with the present invention.

The present invention will be better understood from the following description of operation. The device, as indicated above, may be used indoors for practice which simulates actual outdoor target shooting conditions. The emitter and detector unit 14 is secured to the users shotgun 100 by means of clips 128 and 130 positioned below the barrel forward of the grip as shown in FIG. 9. The switch 110 is attached to the trigger of the shotgun or alternatively may be positioned in the cartridge receiving chamber so that the actuating button 114 will be struck by the firing pin of the weapon when the trigger is pulled. The emitter and detector unit is adjusted in accordance with the requirements of the shooter. The emitter and detector unit can be indexed for both lead and impact point by setting the appropriate adjustment knobs 140, 152 and 154. Because of these features, the shooter can duplicate the correct shot trajectory and lead simulating an actual target traveling at conventional speed and at a desired trajectory angle. For example, to practice leading a target, the adjustment knobs 154 and 152 would be rotated to cause the axis of the emitter and detector unit to be positioned at a selected angle with respect to the axis of the shotgun barrel which trails the barrel. In this way the shooter can practice leading a target as the barrel will lead the target and the emitter will be disposed so that a "hit" will be registered if the proper lead angle is maintained as the emitter is actuated.

The thrower is positioned with a suitable number of targets 12 in the magazine which is accomplished by loosening set screw 94 and removing the U-shaped magazine rod. A desired supply of targets is slipped over rod 96 and the rod replaced in the receiving tube 90. The shooter assumes a desired stance and position and activates the motor 65. Motor 65 may be turned on by means of switch such as remotely operated by a foot pedal 175 seen in FIG. 175. As the motor 65 rotates the output shaft the loading arm 70 will sweep the lower most target forwardly so that it drops onto area 60 resting on the roughened surface. The trailing throwing arm 72 will rotate to position where is engages one of the tensioning pins and, as rotation continues, the tensioning spring 78 will store energy causing the end of the arm to suddenly release from the pin so that the arm impacts the target ejecting it from the thrower. The path and trajectory of the target is established by suitable orientation and angular positioning of the throwing table which can be accomplished by selectively positioning the legs 46 and 48. It is preferred that the detector discriminate so that "hits" are registered only when targets that are in the center two-thirds of the pattern will reflect a light signal of sufficient magnitude so as to cause an audible tone registering a "hit" when received.

It will be obvious to those skilled in the art that various changes, alterations or modifications may be made to the invention described herein. To the extent these various changes alterations and modifications do not depart from the spirit and scope of the appended claims, they are intended to be encompassed therein.

I claim:

1. A target and shooting practice system comprising:

(a) a target having a light reflective surface;

(b) a throwing device including:

(i) a table having an upper surface defining an opening therein and a lower surface spaced from said upper surface defining a target launching area;

(ii) ejection means including drive means operatively connected to a rotatably driven throwing arm;

(iii) a loading arm rotatably driven along said upper surface by said drive means;

(iv) a magazine on said upper surface adapted to receive a plurality of targets, said magazine being positioned so a selected target in said magazine is engageable by the said loading arm to move the selected target to the launching area to be engaged by said throwing arm;

(v) said throwing arm including spring means for storing energy prior to engagement with said targets;

(c) a laser emitter having an actuator which when actuated emits a pulse of light; and (d) light receiving means having detection means for sensing light reflected from the target and including alarm means for signalling receipt of reflected light of predetermined magnitude to indicate a target hit.

2. The target and shooting practice system of claim 1 wherein said throwing device is mounted on support means which are adjustable to vary the flight path of the target.

3. The target and shooting practice system of claim 1 wherein said target has a generally circular surface with a peripheral rim extending thereabout and wherein said reflective surface is disposed on said rim.

4. The target and shooting practice system of claim 1 wherein said laser has mounting means associated therewith for detachably securing said laser to a firearm.

5. A target and shooting practice system comprising:

(a) a target having a light reflective surface;

(b) a throwing device including:

(i) a table having an upper surface defining an opening therein and a lower surface spaced from said upper surface defining a target launching area;

(ii) ejection means including drive means operatively connected to a rotatably driven throwing arm;

(iii) a loading arm rotatably driven along said upper surface by said drive means;

(iv) a magazine on said upper surface adapted to receive a plurality of targets, said magazine being positioned so a selected target in said magazine is engageable by the said loading arm to move the selected target to the launching area to be engaged by said throwing arm;

(v) said throwing arm including spring means for storing energy prior to engagement with said targets;

(c) a laser having an actuator which when actuated emits a pulse of light;

(d) light receiving means having detection means for sensing light reflected from the target and including alarm means for signalling receipt of reflected light of predetermined magnitude to indicate a target hit; and (e) said laser and light-receiving means being disposed in a housing having adjustment means associated with said housing for adjusting the position of the housing.

6. The target and shooting practice system of claim 5 including remotely operable means for actuating the laser.

7. The target and shooting system of claim 6 wherein said remotely operable means is attachable to the trigger of a shotgun.

8. The target and shooting practice system of claim 6 wherein said remotely operable means is configured to be positioned within the firing chamber of a shotgun.

9. The target and shooting practice system of claim 5 further including a lens associated with said housing for selectively adjusting the pattern of the pulse of light.

10. The target and shooting practice system of claim 5 wherein said housing has mounting means associated therewith for detachably securing said housing to a firearm.

11. The target and shooting practice system of claim 5 wherein said housing is part of a simulated firearm.

* * * * *